US005531462A

United States Patent [19]

Gu

[11] Patent Number: 5,531,462

[45] Date of Patent: Jul. 2, 1996

[54] SKATE COMBINATION

[76] Inventor: Show M. Gu, No. 56, Min Sheng Street, Feng Yuan Taichung, Taiwan

[21] Appl. No.: 411,267

[22] Filed: Mar. 27, 1995

[51] Int. Cl.[6] ..... A63C 17/18

[52] U.S. Cl. ..... 280/7.13; 280/7.14; 280/600; 280/11.22

[58] Field of Search ..... 280/7.13, 7.14, 280/7.12, 600, 32, 11.22, 11.27

[56] References Cited

U.S. PATENT DOCUMENTS

| | | | |
|---|---|---|---|
| 710,537 | 10/1902 | Stromsem | 280/600 |
| 1,802,116 | 4/1931 | Kinsley | 280/7.13 |
| 5,320,366 | 6/1994 | Shing | 280/7.14 |
| 5,393,077 | 2/1995 | Wanous | 280/600 |

FOREIGN PATENT DOCUMENTS

| | | | |
|---|---|---|---|
| 2328256 | 2/1975 | Germany | 280/7.13 |

*Primary Examiner*—Anne Marie Boehler
*Attorney, Agent, or Firm*—Charles E. Baxley

[57] ABSTRACT

A skate combination includes a roller skate housing having a cavity formed in the bottom portion for securing wheels so as to form roller skate. A ski board includes a pair of walls for engaging with the cavity. A number of bolts are engaged through the walls and the housing for securing the board to the housing so as to form a ski. The skate combination may be converted from a roller skate to a ski so as to perform both exercises.

1 Claim, 2 Drawing Sheets

SKATE COMBINATION

BACKGROUND OF THE INVENTION

1. Field of the Invention

The present invention relates to a skate, and more particularly to a skate combination that may be used for both roller skate and ski.

2. Description of the Prior Art

Typical roller skates may be used for skating on the road or plane surface only; and typical ski may be used for skiing on snow only. The users have to buy a roller skate and to buy a ski for conducting both of the exercises.

The present invention has arisen to mitigate and/or obviate the afore-described disadvantages of the conventional roller skates and skis.

SUMMARY OF THE INVENTION

The primary objective of the present invention is to provide a skate combination which may be used for both roller skate and ski.

In accordance with one aspect of the invention, there is provided a skate combination comprising a roller skate housing including a bottom portion having a cavity formed therein, a board including wall means extended therefrom for engaging with the cavity of the housing, and means for securing the board to the housing so as to form a ski means.

The wall means includes at least three consecutive orifices formed therein and intersected with each other, the securing means being engaged with either of the orifices so as to adjust the board relative to the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
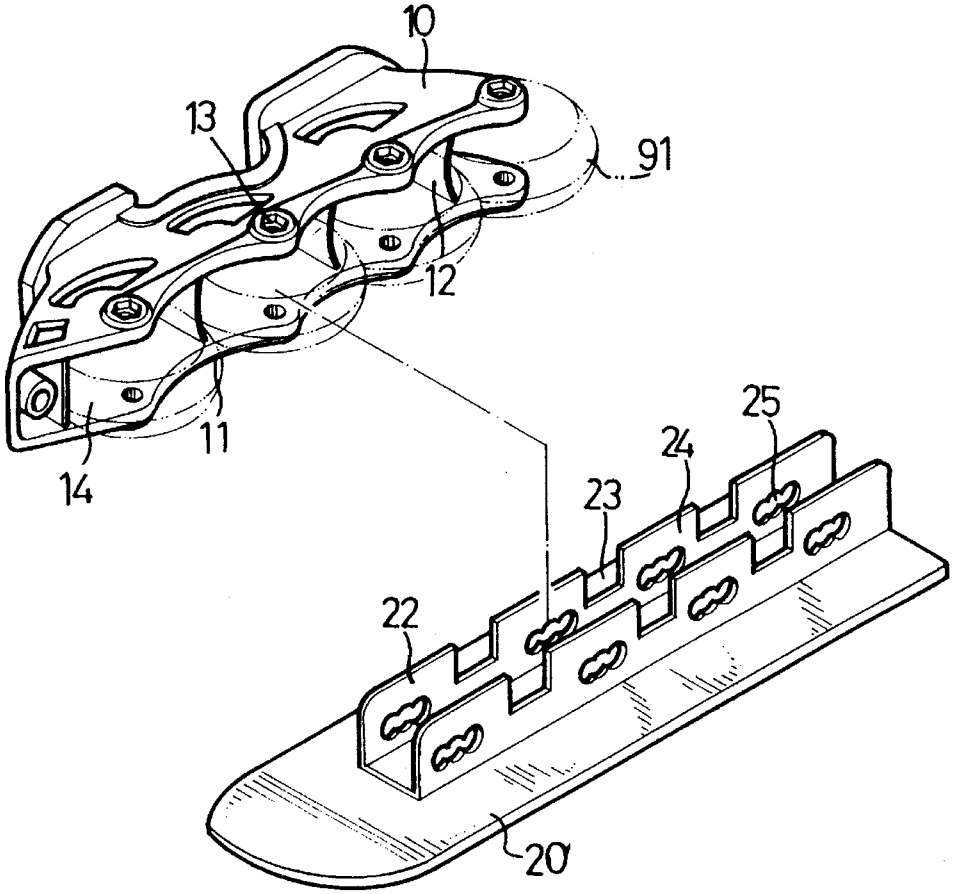
FIG. 1 is an exploded view of a skate combination in accordance with the present invention.
Figure 2:
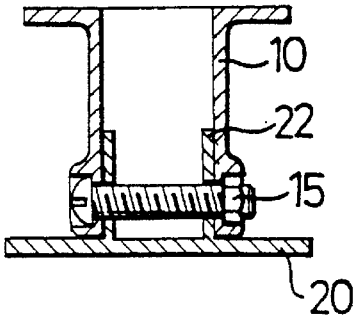
FIGS. 2 and 3 are cross sectional views taken along lines 2—2 and 3—3 of FIG. 4 respectively.
Figure 3:
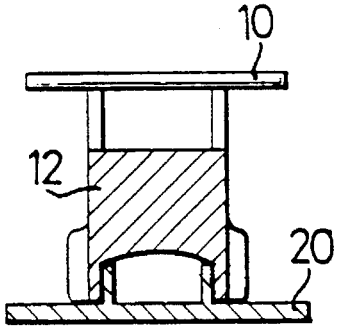
Figure 4:
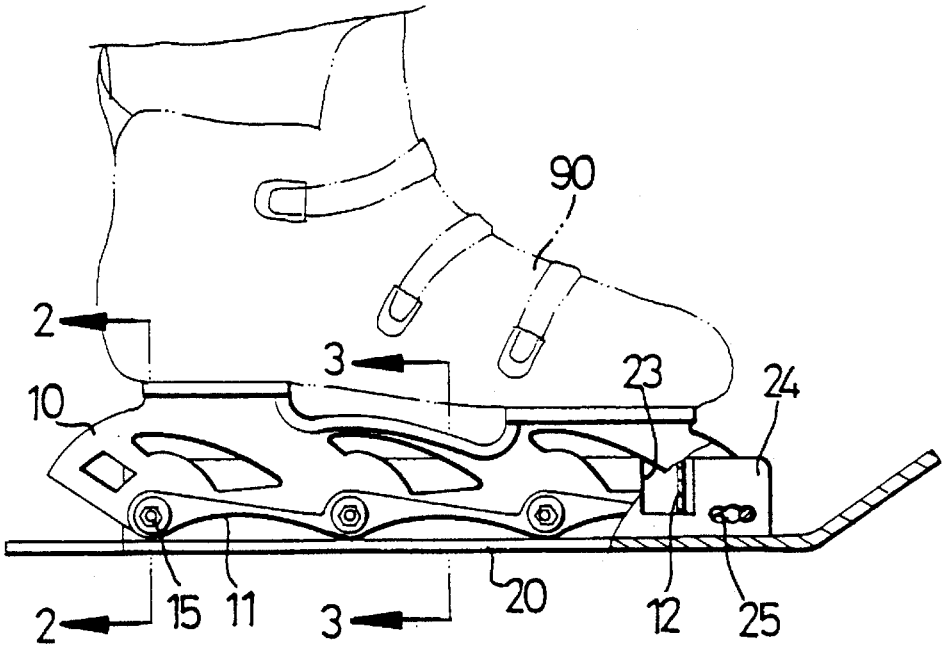
FIG. 4 is a plane view illustrating the operation of the skate combination.

Referring to the drawings, a skate combination in accordance with the present invention comprises a housing 10 for supporting a typical shoe 90 thereon. The housing 10 includes a bottom portion 11 having a cavity 14 formed therein and having three partitions 12 secured therein so as to separate the cavity 14 into four rooms for engaging with wheel means 91 so as to form the roller skate. The housing 10 further includes four pairs of holes 13 for engaging with bolt means 15 and for securing the wheel means 91 to the housing 10.

The skate combination further comprises a board 20 including a pair of parallel wall members 22 extended upward therefrom for engaging with the cavity 14 of the housing 10. The wall members 22 each includes three notches 23 formed therein for engaging with the partitions 12 and so as to form four flanges 24 which are engaged in the rooms respectively. The flanges 24 each includes three consecutive orifices 25 formed therein and intersected with each other. The bolt means 1B may engage with the holes 13 and engage with the orifices 25 so as to secure the board 20 to the housing 10. The bolt means 1B may engage with either of the three consecutive orifices 25 such that the board 20 may be adjusted relative to the housing 10.

Accordingly, the skate combination in accordance with the present invention includes a board which may be disengaged from the housing such that wheel means may be secured to the board in order to form roller skate. The board may also be secured to the housing so as to form ski means.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A combination in-line roller skate and ski comprising:

a frame supporting a shoe thereon, the frame including left and right longitudinal side members spaced from each other and having at least two transverse partitions spanning between the left and right side members to form at least three longitudinally aligned chambers, with each of the chambers organized to receive removably therein a longitudinally oriented wheel journalled between the side members for in-line rotation;

a ski board with parallel longitudinal wall members extending upwardly therefrom for removably engaging with the side members, each of the wall members defining at least three upwardly extending flanges with at least two notches formed therebetween, each of the notches in the left wall member arranged in a pair with a corresponding notch in the right wall member, the partitions each adapted for insertion into one of the pairs of notches so as to position a flange of the left wall member and a flange of the right wall member into each of the chambers for stable engagement therewith;

each of the flanges provided with at least three longitudinally spaced hole sets, with each of the hole sets in one of the wall members paired with a corresponding one of the hole sets in the other of the wall members;

three securing bolts for securing the ski board to the side members on removal of the wheels so as to comprise a ski, one of the securing bolts each engageable in one pair of the three holes of each hole set so as to allow adjustment of longitudinal spacing of the ski board relative to the frame and the shoe.

* * * * *